United States Patent [19]

Sjöstedt et al.

[11] 4,416,121

[45] Nov. 22, 1983

[54] DEVICE FOR THE RECOVERY OF HEAT

[75] Inventors: Bertil Sjöstedt, Flen; Gunnar Carlsson; Hans Lindholm, both of Katrineholm, all of Sweden

[73] Assignee: Elektro Standard AB, Katrineholm, Sweden

[21] Appl. No.: 324,353

[22] PCT Filed: Apr. 24, 1981

[86] PCT No.: PCT/SE81/00126

§ 371 Date: Nov. 18, 1981

§ 102(e) Date: Nov. 18, 1981

[87] PCT Pub. No.: WO81/03219

PCT Pub. Date: Nov. 12, 1981

[30] Foreign Application Priority Data

Apr. 30, 1980 [SE] Sweden ..... 8003303

[51] Int. Cl.[3] ..... F25B 27/02

[52] U.S. Cl. ..... 62/238.6; 237/2 B

[58] Field of Search ..... 62/238.6, 324.5, 183; 237/2 B

[56] References Cited

U.S. PATENT DOCUMENTS

| | | | |
|---|---|---|---|
| 1,935,281 | 11/1933 | Reed | 62/238.6 X |
| 2,575,325 | 11/1951 | Ambrose et al. | 62/238.6 X |
| 3,984,050 | 10/1976 | Gustafsson | 62/238.6 X |
| 3,986,664 | 10/1976 | Gustafsson | 62/238.6 X |
| 3,989,183 | 11/1976 | Gustafsson | 62/238.6 X |
| 4,098,092 | 7/1978 | Singh | 62/238.6 |
| 4,179,894 | 12/1979 | Hughes | 237/2 B |
| 4,213,563 | 7/1980 | van Kuijk | 237/2 B |
| 4,246,764 | 1/1981 | Papakados | 62/183 |
| 4,293,323 | 10/1981 | Cohen | 62/238.6 |
| 4,315,597 | 2/1982 | Garraffa, Jr. | 62/238.6 X |
| 4,336,692 | 6/1982 | Ecker et al. | 62/238.6 X |

FOREIGN PATENT DOCUMENTS

| | | | |
|---|---|---|---|
| 2558227 | 7/1977 | Fed. Rep. of Germany | 62/238.6 |
| 3,027,609 | 2/1982 | Fed. Rep. of Germany | 62/238.6 |

*Primary Examiner*—Lloyd L. King

*Attorney, Agent, or Firm*—Pollock, Vande Sande & Priddy

[57] ABSTRACT

A heat recovery device comprising a heat pump (1) the vaporizer of which receives heat from the exhaust air (P1) of a building and the condenser (6) of which delivers heat to the water in a container (2) for hot consumption water. A circulation circuit (14,11,12,9) for the recovery of excess heat from the container (2) to the building is arranged in heat transferring contact with the water in a lower part (Z1) of the container (2), the condenser (6) and a supply connection (9) for cold water being likewise situated in the lower part of the container. This arrangement results in separation of the water temperature in the container (2) and increased efficiency of the heat pump (1).

10 Claims, 7 Drawing Figures

P3
P1
P2
1
2
3
4
5
6
7
8
9
10

4
3
2
1
10
20
30
40
50
60°C
T 22
20
21
25
26
27
24
26
37
36
35
34
28
32
33
12
31
23
14
P1
P2
P3
1
2
8
18
6
9
P5
16
P4
29'
30'
29
30

DEVICE FOR THE RECOVERY OF HEAT

The present invention relates to a heat recovery device.

FIG. 1 illustrates such a previously known device comprising a heat pump 1 and a container 2 for consumption hot water. The heat pump transfers heat from a heat source, namely from the exhaust air from a building, to the water in the container 2. For this purpose, the exhaust air is drawn (arrow P1), at a temperature of, e.g., 22° C. by means of a fan 3 past the evaporator 4 of the heat pump (arrow P2), so that the outflowing air (arrow P3) leaves the device at a substantially lower temperature, e.g., 5° C. By means of a compressor 5, the heat carrying medium is pumped to a condenser 6 located in the lower part of the hot water container 2, from which heat is transferred to the ambient water. From the condenser 6, the heat carrying medium is returned via a throttle 7 to the evaporator 4.

Hot water is discharged via a connection 8 located in the upper part of the container 2, whereas cold water is supplied via a lower connection 9. A temperature sensor 10 controls the compressor 55 of the heat pump so that the water temperature in the container 2 is kept at a desired level, e.g., 55° C.

It is recognized that, by this method, heat can be pumped from the exhaust air to the hot water only to the extent that the hot water is discharged from the container 2 (on the assumption that the container is well insulated so that heat loss to the environment is negligible). An obvious method to solve this problem and enable continuous recovery of heat from the exhaust air to the building would be to let hot water circulate from the discharge connection 8 of the container 2 via a water radiator 11 to the supply connection 9 by means of a circulation pump 12, as shown in FIG. 3. In this figure, for the sake of simplicity, the various parts of the heat pump 1 are left out. However, the condenser 6 in the container 2 is shown. In the re-circulation circuit, there is also a non-return valve 13 preventing cold water from flowing backwards through the radiator 11, when for some reason the pump 12 does not work.

With the embodiment shown in FIG. 3, one obtains the advantage that the heat pump 1 can work continuously. However, a remaining problem is that the efficiency of the heat pump is unsatisfactory.

Therefore, the object of the invention is to substantially improve the efficiency of the heat pump so as to further reduce the total energy consumption in the building, in which the device is installed.

The invention is based on the knowledge that the efficiency of the heat pump strongly depends on the temperature difference between the condenser 6 and the vaporizer 4. The functional temperature T (for a given temperature of the vaporizer 4) is shown in FIG. 2. As an example, the efficiency factor is about 2 in the above-mentioned example, i.e., at a condenser temperature of about 55° C., while the efficiency factor can be doubled, i.e., to about 4, if the condenser 6 can be brought to work at a temperature of about 10° C. Even a moderate temperature reduction could, however, result in a substantial improvement, since the relation is essentially linear.

In order to achieve the stated object, the inventive device has a means for recovery of heat from the hot water container consisting of a fluid circulation circuit, which is in heat transferring contact with the water in the lower part of the hot water container, in which lower part the condenser of the heat pump and the cold water supply connection are located.

This arrangement has made it possible to achieve a formation of layers in the hot water container, a lower zone containing relatively cold water, e.g., of about 30° C., and an upper zone containing relatively hot water, e.g., of about 55° C. Hereby, the efficiency factor of the heat pump can be maintained above 3, which in a typical single-family house corresponds to an energy saving of about 40%, provided that the hot water consumption and the heat delivered by the fluid circulation circuit (via, e.g., a water radiator or a supply air device) altogether amount to about 60% of the total heat energy consumption.

In order that the invention may be more clearly understood, reference will now be made to the accompanying drawings, wherein several embodiments are shown for purposes of illustration, and wherein.

Figure 3:
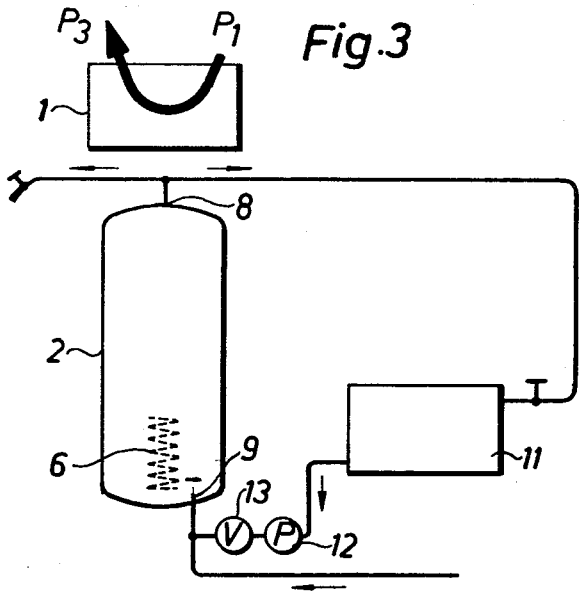
Figure 4:
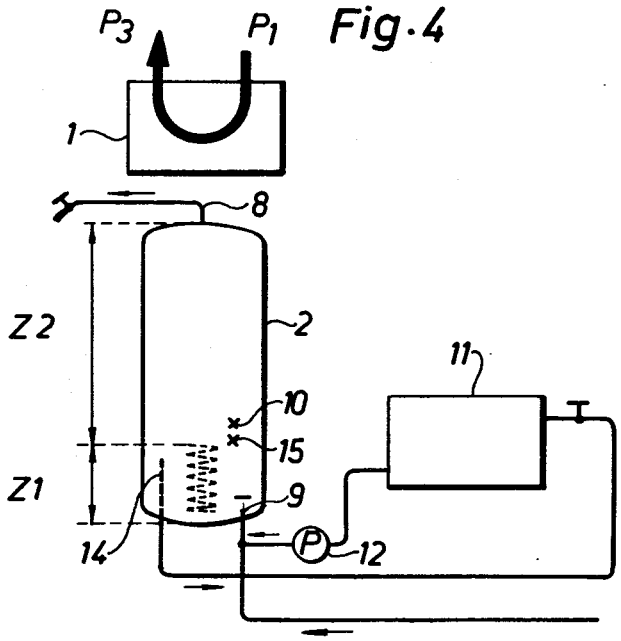
FIG. 4 shows schematically first embodiment of the heat recovery device according to the invention.

The heat recovery device shown in FIG. 4 is similar to the device discussed above and shown in FIG. 3, and corresponding parts are given the same reference numerals. However, there is an essential difference in that both connections of the water circulation circuit 11, 12 are located in the lower part of the hot water container 2 adjacent to the heat pump condenser 6. Thus, the feed conduit connection 14 is disposed near and somewhat below the upper edge of the condenser 6, whereas the return conduit connection, which is joined to the supply connection 9 for cold water, is located near and somewhat below, the lower edge of the condenser 6. Moreover, the system is controlled by two temperature sensors, namely a first temperature sensor 10, which corresponds to the sensor 10 in the prior art embodiment shown in FIG. 1 and which, thus, assures that the heat pump will work as long as the water temperature at the sensor is below the desired hot water temperature, e.g., 40°–60° C., preferably about 55° C., and a second temperature sensor 15, which assures that the pump 12 will work and the water in the circulation circuit with the radiator 11 will circulate as long as the water temperature at this sensor exceeds a predetermined temperature of, e.g., 30°–50° C., and preferably about 40° C.

Since the connections 14 and 9 are situated in the region of the condenser 6, the latter can be kept at an advantageously low temperature level, resulting in improved efficiency of the heat pump. The return conduit connection 9 is also provided with a deflecting plate which assures that the incoming water does not flow upwards, but only sideways. Thus, in the lower part of the container, a zone Z1 having a relatively low temperature can be maintained, whereas in the upper part of the container there remains a zone 2 with warmer water (having a lower density). Due to such a temperature distribution in the container 2, it is possible to achieve improved efficiency of the heat pump, while preserving the desired hot water temperature (at the discharge connection 8).

Figure 1:
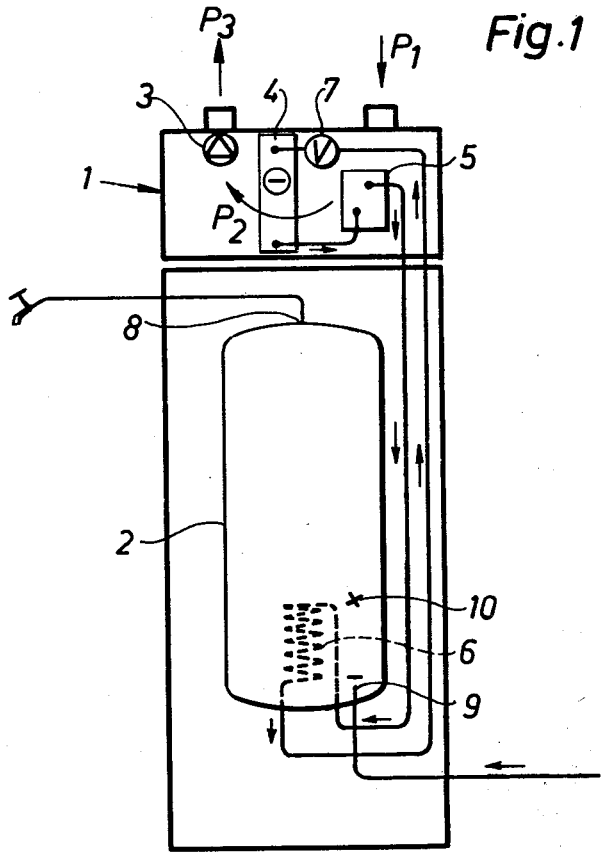
FIGS. 1 to 3 illustrate the background of the invention.
Figure 2:
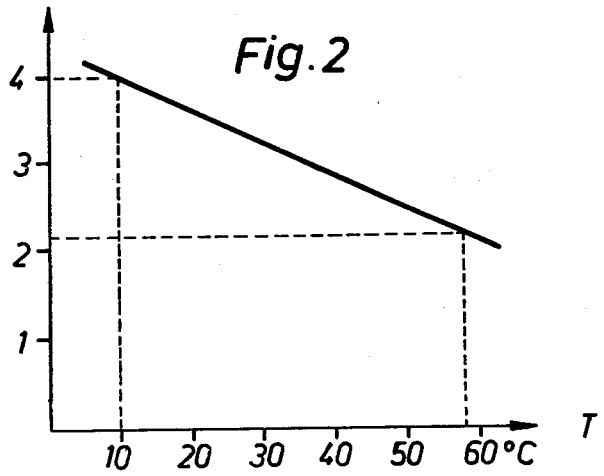
Figure 5:
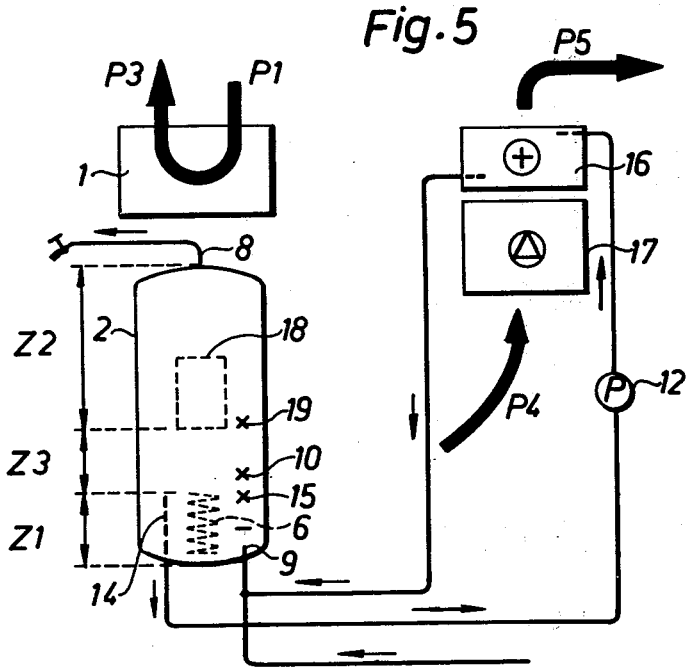
FIGS. 5 to 7 show, respectively, a second, a third and a fourth embodiment.

FIG. 5 shows a second embodiment of the heat recovery device, and corresponding parts are given the same reference numerals as in FIGS. 1, 3 and 4. In this case, there is likewise a water circulation circuit which, via connections 9 and 14, is in heat transferring contact with the water adjacent to the condenser 6 of the heat pump. Instead of a radiator, the circulation circuit contains a supply air unit having a hot water element 16, e.g., a heating element with flanges, and a fan 17 which cause the supply air to the building to pass the element 16 and thereby be preheated, at least up to 15°–20° C. (depending on the temperature of the outdoor air) before being blown into the interior of the building. In FIG. 5 the supply air flow is schematically indicated 2, i.e., in the upper zone Z2, electrical additional heating elements 18 are arranged. These elements 18 are controlled by an adjacent third temperature sensor 19, which turns on the elements 18 as soon as the water temperature in zone Z2 falls somewhat below the desired hot water temperature, e.g., at a temperature of 40°–90° C., preferably about 65° C. The temperature sensor 10, controlling the compressor of the heat pump 1, is in this case located in an intermediate zone Z3 between the upper and lower zones Z2 and Z1. As in the previous embodiment, the heat pump operates as long as the water temperature at the sensor 10 does not exceed the desired hot water temperature, namely, a temperature of, e.g., 40°–60° C., and preferably about 55° C.

In this case, the sensor 15 can preferably control the fan 17 (instead of the pump 12, which can work continuously) so that the supply air is delivered as long as the sensed water temperature (and thus approximately the temperature of the heating element 16) does not fall below 5° to 15° C., preferably about 10° C.

Thus, in this embodiment the condenser 6 can operate at a lower temperature, whereby the efficiency of the heat pump will increase, as discussed above.

Figure 6:
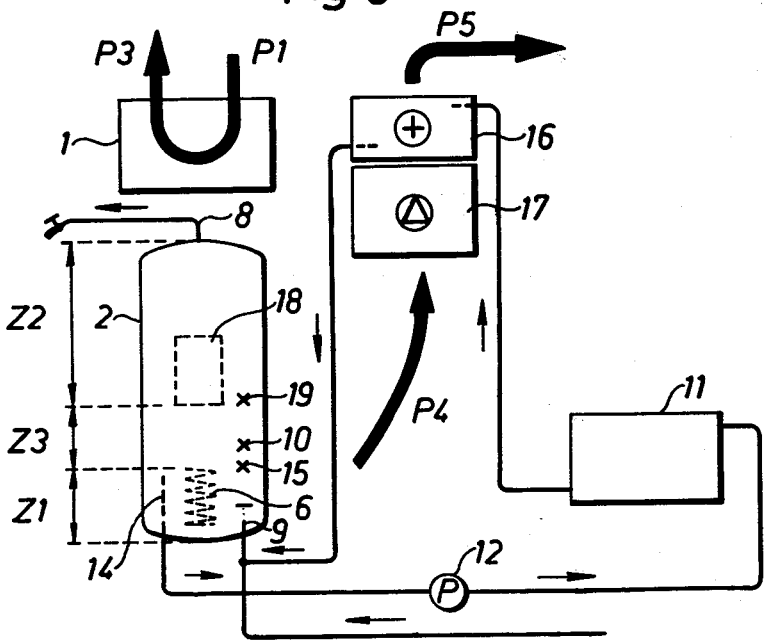

The embodiment according to FIG. 6 operates substantially in the same way as FIG. 5. The only difference is that a water radiator 11 (compare FIG. 4) is connected in the water circulation circuit between the pump 12 and the heating element 16. In this case, the excess heat is transferred from the container 2 to the supply air (P4, P5) as well as to the room air (via the radiator 11).

Figure 7:
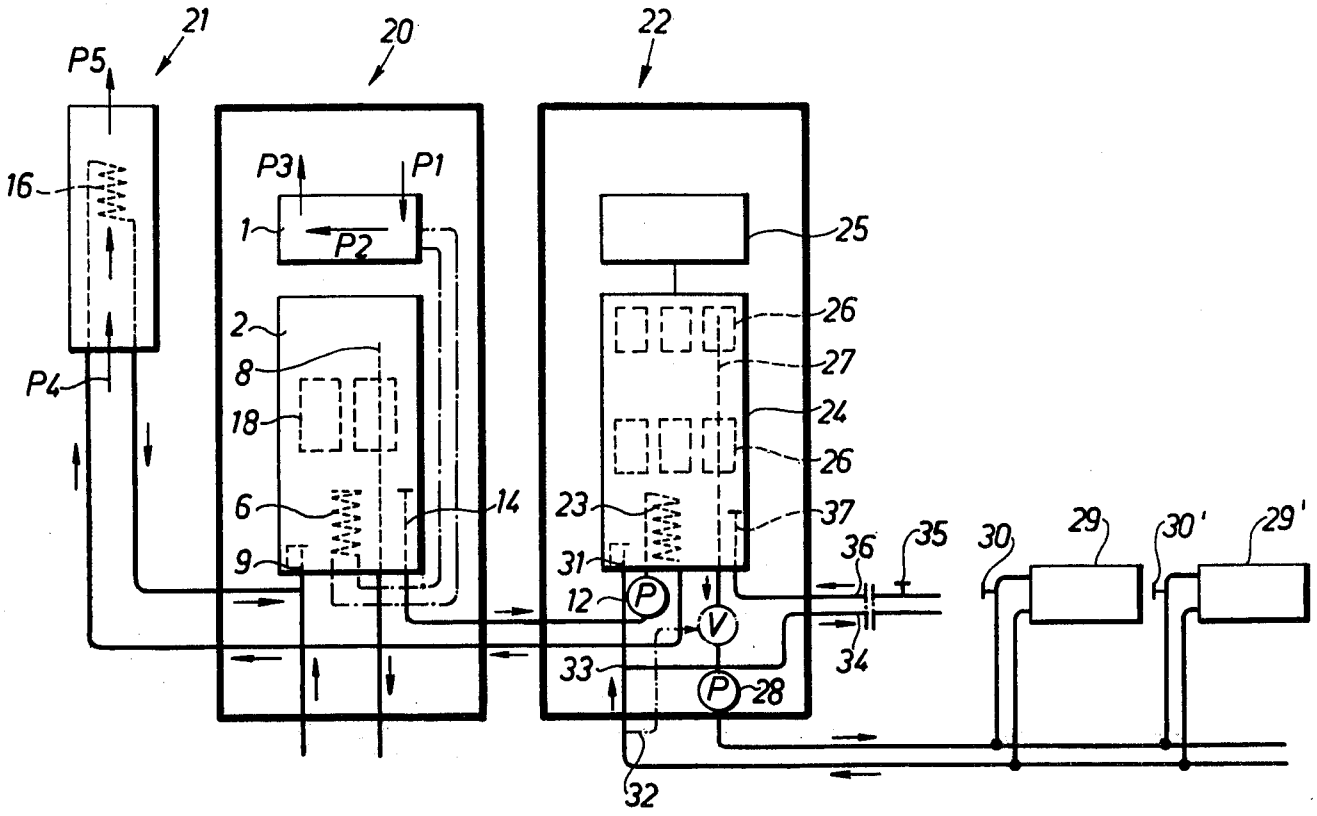

A further application of the invention is schematically shown in FIG. 7, wherein the units 20 and 21 jointly correspond to the embodiment according to FIG. 5. Thus, the water circulation circuit from the feed conduit connection 14 to the return conduit connection 9 in the lower part of the container 2 comprises a supply air unit 21. However, this circulation circuit is also provided with a heat exchanger loop 23 disposed in the lower part of a central heating unit 22. This unit comprises a central heating vessel 24 and an expansion vessel 25 connected thereto. Apart from the heat exchange loop 23, electrical heating elements 26 are arranged in the vessel 24 for heating the water, if necessary. From an upper feed conduit connection 27 the water circulates in the building (by means of a pump 28) in a loop comprising radiators 29, 29', etc. (each having a thermostatic valve 30,30', etc.) and back to a return connection 31. As shown by dashed lines, a shunt 32 can be arranged in conventional manner in the radiator loop. In the illustrated example, there is still another possibility of heating the water in the heating vessel 24, namely by means of an additional circulation circuit extending from the return conduit 33 of the radiator loop via a conduit 34 to an exchanger loop in a (not illustrated) heating device, such as a solar panel, a fireplace, a stove, a wood heater or the like, and back to the vessel 24 via a cut-off valve 35, a conduit 36 and a return conduit connection 37. It is understood that the water in the vessel 24 can be heated in three different ways, simultaneously or separately, namely, via the heat pump 1 and the hot water container 2, by means of the electrical elements 26 or by means of the (not-illustrated) heating device and the circulation circuit 33, 34, 35, 36, 37.

Even in the vessel 24, a separation into different hot zones can be achieved, in which the exchanger loop 23 and the circulation circuit 33–37 serve to preheat the return water from the radiator loop, whereas the electric elements 26 finally heat the water to a desired temperature.

The invention can be modified in several different ways within the scope of the following attached claims. Thus, the re-circulation circuit from the hot water container may, e.g., contain some medium other than water, in which case an exchanger loop is arranged instead of the open connections 9 and 14. The essential point is that the heat exchange is effected in the lower part of the container 2 in the region of the condenser 6 of the heat pump, so that the described temperature destribution can be maintained in the container 2.

Moreover, the heat may derive heat from a heat source other than the exhaust air, e.g., from a water tank, a salt reservoir or the like, which is fed with heat energy at least intermittently via solar panels or in some other way. However, the disposal of the vaporizer of the heat pump in heat transferring contact with the exhaust air from the building, as described above, will probably give the best result, at least in relation to the required investment in technical equipment.

We claim:

1. A device for supplying heat in a building, comprising a compressor driven heat pump (1), the vaporizer (4) of which is adapted to receive heat from a heat source, and the condenser (6) of which is situated in the lower part (Z1) of a container (2) for consumption hot water, a supply connection (9) for cold water being likewise situated in said lower part (Z1) of the container (2), whereas the hot water discharge connection (8) is situated in the upper part of the container (2), and means for transferring heat from said lower part (Z1) of the container (2) to said building, said heat transfer means comprising a liquid circulation circuit (14, 12, 11, 16, 9) in heat transferring contact with the water inside said container (2) in the region of said condenser (6), said liquid circulation circuit being arranged to emit heat to the building outside said container (2) via at least one liquid circulation element (16, 11, 23).

2. A device according to claim 1, wherein said liquid circulation circuit contains water and is provided with feed and return conduit connections (14, 9) in the region of said condenser (6).

3. A device accordint to claim 22, wherein said return conduit connection (9) of said water circulation circuit is joined to said supply connection (9) for cold water.

4. A device according to claim 2 or 3, wherein said return conduit connection (9) is located adjacent to the lower part of said condenser (6), while said feed conduit connection (14) is located adjacent to the upper part of said condenser (6).

5. A device according to claim 1, wherein said at least one liquid circulation element comprises a supply air unit (16) and/or a radiator (11) and/or a heat exchanger (23) in a central heating vessel (24).

6. A device according to claim 1, wherein said liquid circulation circuit is adapted to operate intermittently in response to the water temperature (15) in said lower part (Z1) of said container (2).

7. A device according to claim 1, comprising additional heating elements (18) arranged in said container (2) at a level above said condenser (6).

8. A device according to claim 5, comprising a heat exchanger (23) in a central heating vessel (24), said heat exchanger (23) being arranged in a lower part of said vessel.

9. A device according to claim 8, wherein electric heating elements (26) are arranged in an upper part of said vessel.

10. A device according to claim 8 or 9, wherein said central heating vessel (24) by means of a second liquid circulation circuit (33–37) is arranged in heat transferring contact with a solar panel or a fireplace, such as an open fireplace, a stove, a wood heater or the like.

* * * * *